United States Patent [19]

Bacsik

[11] 4,321,130

[45] Mar. 23, 1982

[54] THERMAL CONVERSION OF HYDROCARBONS WITH LOW ENERGY AIR PREHEATER

[75] Inventor: George J. Bacsik, Fanwood, N.J.

[73] Assignee: Exxon Research & Engineering Co., Florham Park, N.J.

[21] Appl. No.: 100,468

[22] Filed: Dec. 5, 1979

[51] Int. Cl.[3] ..... C10G 9/16

[52] U.S. Cl. ..... 208/130; 208/106; 585/602; 585/634; 585/652; 585/910

[58] Field of Search ..... 208/130, 106; 585/602, 585/634, 652, 910

[56] References Cited

U.S. PATENT DOCUMENTS

| | | | |
|---|---|---|---|
| 2,750,420 | 6/1956 | Hepp | 568/467 |
| 3,283,028 | 11/1966 | Bergstrom et al. | 585/634 |
| 3,426,733 | 2/1969 | Wiesenthal | 122/1 R |
| 3,469,946 | 9/1969 | Wiesenthal | 422/204 |
| 3,980,452 | 9/1976 | Krumm et al. | 48/215 |

FOREIGN PATENT DOCUMENTS

| | | | |
|---|---|---|---|
| 819761 | 9/1974 | Belgium | 48/215 |

*Primary Examiner*—Delbert E. Gantz
*Assistant Examiner*—G. E. Schmitkons
*Attorney, Agent, or Firm*—Rebecca Yablonsky

[57] ABSTRACT

Combustion air, prior to being introduced into the cracking furnace in a hydrocarbon pyrolytic conversion and separation system, is preheated by employing bottom pumparound, top pumparound and/or quench water streams diverting from the primary fractionator externally connected to the pyrolysis reactor in order to optimize the thermal efficiency of the overall process.

13 Claims, 2 Drawing Figures

96%
91.8%
91.2%
90.3%
87.9%
85.8%
95
90
85
80
TOTAL HEAT ABSORBED / HEAT FIRED (LHV) X 100
143°F
310°F
329°F
350°F
461°F
542°F
100
200
300
400
500
600
STACK °F

THERMAL CONVERSION OF HYDROCARBONS WITH LOW ENERGY AIR PREHEATER

BACKGROUND OF THE INVENTION AND PRIOR ART

1. Field of the Invention

The present invention relates to a novel scheme which minimizes fuel consumption in thermally cracking a hydrocarbon feedstock and separating the cracked product. In particular, it relates to thermal cracking of a hydrocarbon feedstock in the presence of steam at temperatures of about 1200° to 1800° F. More specifically, it pertains to preheating combustion air, before it is blown into the thermal cracking furnace, in a heat exchanger by employing bottom pumparound (BPA), top pumparound (TPA) and/or quench water (QW) streams extracted from the primary fractionator which is externally connected to the pyrolysis tubular metal reactor located within the furnace. The heat transferred at low temperatures to the combustion air becomes available above the unheated fuel adiabatic flame temperature for transfer to the furnace tubular reactor.

2. Description of the Prior Art

Since the thermal efficiency of a pyrolysis reactor furnace depends on how much of the thermal energy released from the fuel has been absorbed and utilized within the furnace, efforts have been made to lower the temperature of the combusted flue gas leaving the furnace, thereby maximizing the recovery of the fuel energy. One approach towards reducing the flue gas temperature has been to use the flue gas to preheat the combustion air used in the furnace burners. This recovers heat from the flue gas and improves the overall thermal efficiency of the furnace. The concept of preheating the combustion air with the flue gas stream has been extensively studied.

Unfortunately, however, utilization of the flue gas in preheating the combustion air is attended by several inherent engineering disadvantages. First of all, it requires a high investment for the installation of blowers, drivers, insulated ducts and other miscellaneous equipment needed to transport the hot flue gas to a heat exchanger wherein heat transfer between the flue gas and the combustion air takes place. Further, the heat exchanger and part of the flue gas transportation equipment are vulnerable to corrosion as they are in direct contact with acidic components of the cooled flue gas. Finally, the regenerative heat exchanger normally employed for this is subject to outages which deleteriously affect the furnace service factor.

Another approach proposed for improving the thermal efficiency of the hydrocarbon thermal conversion system has been to preheat the combustion air by employing the pyrolysis product stream which leaves the pyrolysis reactor at high temperatures, e.g., 1200° to 2000° F. Thus, Bergstrom et al. in U.S. Pat. No. 3,283,028 have disclosed a pyrolysis reactor of special construction which provides for passage of cool air into the apparatus in indirect heat exchange with the hot conversion products after which it is used as combustion air for the fuel to the reactor. These patentees are therefore not teaching the use of low level temperature waste heat streams for air preheat. Belgian Pat. No. 819,761 (Equiv. U.S. Pat. No. 3,980,452) concerns steam reforming in which the hot product gases are used to preheat combustion air; the latter is then passed to an air preheater where it is heated further by exchange with flue gases.

Wiesenthal, in his U.S. Pat. No. 3,426,733, is essentially concerned with a furnace for heating hydrocarbons in which he uses a portion of the feed stream, which is assumed to be already at elevated temperature, for combustion air preheating, then uses the cooled stream to extract heat from the flue gases. In FIG. X, which is the only embodiment suggested for carrying out a chemical process in the furnace, the entire feed stream is first heated in the convection section of the furnace, then is used for combustion air preheating, then is passed through the convection coil and finallly through the radiant heating coil of the furnace. Wiesenthal, in his U.S. Pat. No. 3,469,946, circulates a heat transfer fluid in a closed loop between the convection section and the combustion air, collecting heat in the former and donating this heat to the combustion air.

Hepp in U.S. Pat. No. 2,750,420 uses three pebble heat exchangers in which the pebbles flow downwardly by gravity and at the bottom are hoisted up to the top. The pebbles directly contact successively: the hot pyrolysis effluent gas; combustion air for the furnace; incoming hydrocarbon feed, so that in effect the pebbles quench the pyrolysis products and heat taken up thereby serves as combustion air preheat and as feed preheat. The contacting of the pebbles with pyrolysis products which contain reactive unsaturated monomers and then with air is undesirable since the two are incompatible; also the refractory material can act as a catalyst for polymerization of the monomers and/or as a catalyst for undesirable further cracking which impairs selectivity to valuable components.

SUMMARY OF THE INVENTION

It has now been discovered that improved heat recovery by preheating the combustion air for the furnace burners can be realized in a pyrolytic hydrocarbon conversion/separation system without incurring expensive initial investment costs or the various operating difficulties mentioned above. Now, in accordance with the subject invention, the combustion air is preheated in an indirect heat exchange relationship by employing low temperature waste heat streams, i.e., TPA, BPA and QW streams and the like, either alone or in combination, diverted from the primary fractionator wherein the quenched pyrolysis product components are separated according to their boiling points. The furnace stack temperature or the flue gas temperature is lowered by directly feeding the hydrocarbon feedstock at ambient or other temperatures into the convection zone of the pyrolysis reactor. Thermal cracking of the hydrocarbon feedstock is completed in the radiant zone of the furnace or pyrolysis reactor in the presence of steam which may be preferably made to join the hydrocarbon feedstream at the inlet or at a point or points along the convection zone. By recovering thermal energy, which would otherwise be discarded, from such sources as the QW, TPA and BPA streams, it is now possible to maximize the thermal efficiency of the pyrolysis reactor. Other merits and advantages of the present invention will become apparent in the following description.

DETAILED DESCRIPTION

Figure 1:
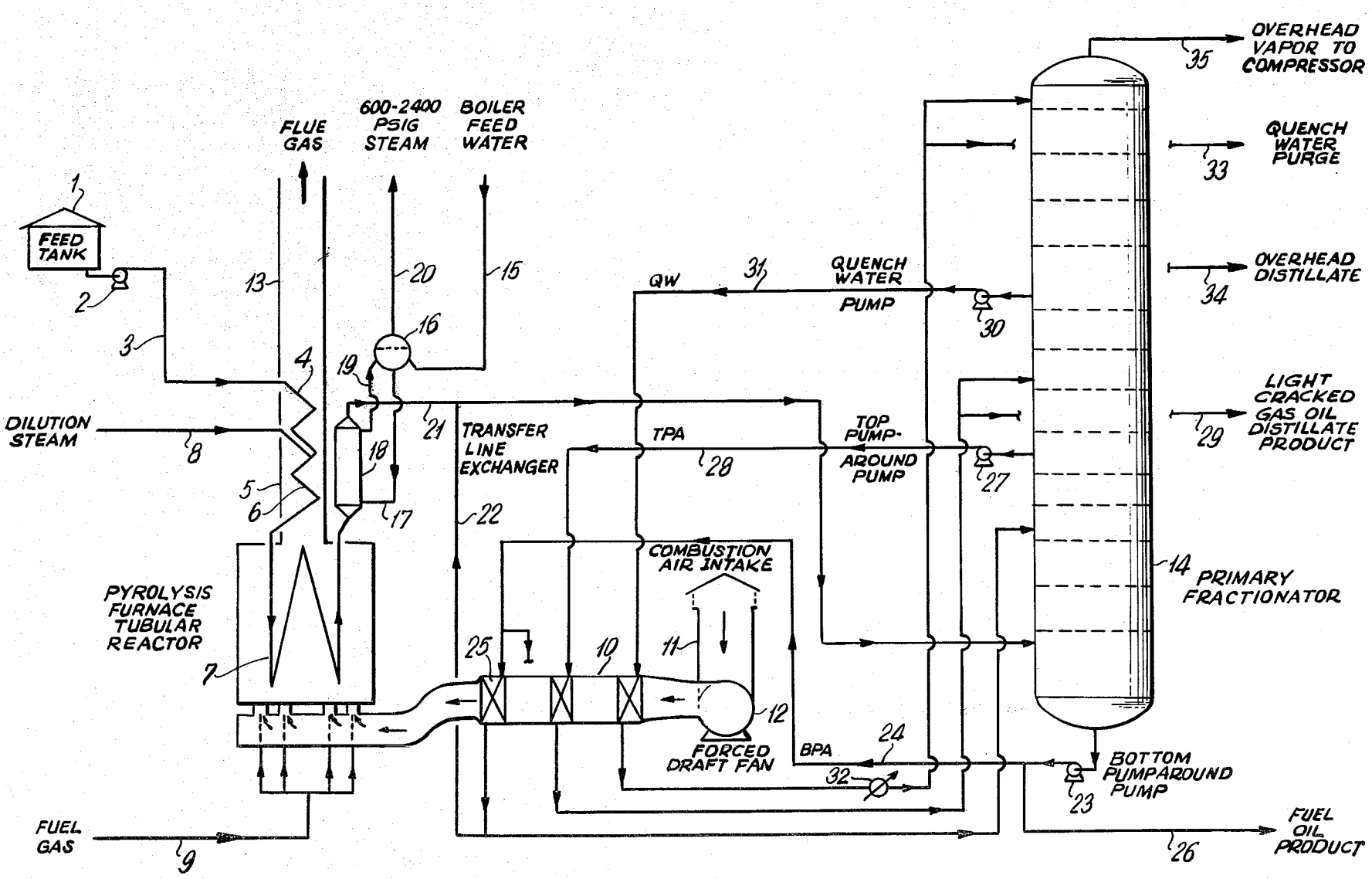
FIG. 1 is a flow diagram illustrating the invention.

For the purpose of the present invention, the quench water (QW) stream is taken to mean the cooling water stream, employed at the uppermost portion of the fractionator, to remove heat from this portion of the primary fractionator thereby cooling the tower overhead vapors, condensing the overhead distillate and reflux streams as well as condensing steam. The overhead vapor stream is comprised of uncondensed gaseous hydrocarbon products containing principally olefins and diolefins having up to six or more carbon atoms per molecule, hydrogen and some uncondensed steam. The overhead vapor stream is directed to the process gas compressor and light ends processing section to recover ethylene, propylene, butenes, butadiene and the like. The overhead distillate contains liquid hydrocarbons boiling below about 430° F. The steam condensed by the quench water leaves the system as a liquid stream called quench water purge. The top pumparound (TPA) stream comprises light cracked gas oil distillate product having a preferred boiling range of from about 350° to 750° F. and more preferably from about 430° to about 650° F. extracted from the next upper portion of the primary fractionator. The bottom pumparound (BPA) stream consists of quench oil product, which is normally employed to quench the pyrolysis reactor effluent. The BPA could be a liquid distillate or residuum, called fuel oil product, which has an initial boiling point of about 550° F. or higher and an end point of about 1200° F. or higher. The BPA distillate would have the maximum operable end point and thus has a boiling range of about 550° to about 700° F. The BPA is withdrawn from the bottom of the primary fractionator as shown or from the lower portion of the fractionator and above the flash zone as a distillate.

A large spectrum of hydrocarbons such as vacuum gas oils, heavy atmospheric gas oil, light atmospheric gas oil, kerosene, naphthas, natural gases and the like can be thermally cracked in the presence of steam to produce various unsaturated hydrocarbons in admixtures, including acetylene, ethylene, propylene, butenes, butadiene, isoprene and the like. A stream containing any of the feed hydrocarbons listed above may be introduced, at ambient or other temperatures, e.g., 80° F., into the convection zone of the pyrolysis reactor furnace, thereby lowering the temperature of the flue gas leaving the furnace to the range of from about 200° to about 400° F., preferably from about 200° to about 300° F., and more preferably from about 200° to 250° F. A suitable proportion of steam at about 100 to about 175 psig may be added to the hydrocarbon feedstock, preferably at the inlet or in the convection zone, to make the resulting pyrolysis mixture containing from about 17 to 45 weight percent steam. The reaction mixture is then further heated, with short contact times, in the radiation zone which is directly exposed to furnace burner flame. The normal residence time of the pyrolysis reaction mixture within the reaction may be shorter than a second, e.g., in the range of from less than about 0.1 to about 0.6 second. Immediately upon leaving the outlet of the pyrolysis reactor, the thermally cracked product stream is quenched as by introducing and mixing therewith a cooler stream of oil such as a BPA stream; and may also preferably be passed through a transfer line heat exchanger wherein steam at pressures ranging from 110 to about 1800 psig or higher is generated. If needed, additional quenching may be employed so that the mixture of cracked products and the steam cracked gas oil fraction and high boiling bottoms fraction is introduced into the bottom of the primary fractionator at a temperature in the range of 350° to 650° F. and preferably 525° to 600° F.

The components of the pyrolysis reactor effluent may then be separated in the primary fractionator into the several product streams; e.g., the tower overhead vapor stream which is comprised of hydrogen, uncondensed gaseous hydrocarbon products containing principally olefins and diolefins having up to six carbon atoms or more per molecule and uncondensed steam; the overhead distillate product which contains liquid hydrocarbons boiling below about 430° F.; condensed steam leaving as quench water purge; light cracked gas oil product or TPA product having a preferred boiling range of from about 350° to about 750° F. and more preferably from about 430° to about 650° F.; and a fuel oil product or BPA product which has an initial boiling point of about 550° F. or higher. The BPA product could be a liquid distillate product in which case the fractionator bottoms is a fuel oil product having the maximum operable initial boiling point. The BPA and/or TPA streams so fractionated, and/or the QW stream used to remove heat in the upper portion of the fractionator may be routed to a heat exchanger or heat exchangers to preheat the combustion air for the pyrolysis furnace burners to a temperature ranging from about 150° to about 450° F. and preferably from about 270° to about 425° F. before the combustion air enters the furnace burners. Preferably the BPA, and more preferably, the BPA supplemented by the TPA and/or the QW streams may be so employed.

Another significant economical and ecological advantage derived from the instant invention lies in the recovery and reuse of the thermal energy which is normally discarded to the atmosphere. By recovering this thermal energy from the BPA, the TPA and especially from the QW stream and decreasing the fuel fired in the pyrolysis furnace, it is possible to reduce thermal pollution as well as to maximize the conservation of thermal energy and valuable fuel gas or oil. It follows that less utilities (e.g., cooling water, cooling air, power, etc.) are required to reject the remaining waste low temperature level heat in the BPA, TPA and QW which must ultimately be rejected to the atmosphere. Also, fuel gas is conserved while less stack flue gas is rejected to the atmosphere.

An important advantage of the invention is that the process cracking conditions can be optimized by controlling combustion air preheat. Thus, the temperature of the preheated air can be controlled at any desired level. The adiabatic and radiating flame temperature increases directly with the preheated combustion air temperature. The radiant heat flux in the pyrolysis tubular reactor is a function of the flame (or flue gas) and refractory temperature. Therefore, controlling the air preheat temperature controls the heat density or flux. This is very important in achieving optimal yield patterns and furnace service factors.

The inventive concept, although described as primarily applicable to a hydrocarbon pyrolysis system, may readily be employed in various refinery processes such as pipestill furnaces, fluid catalytic cracking plant furnaces and the like where low temperature level streams are available as heat recovery sources.

By low level temperature is meant temperatures in the range of about 100° to about 500° F., preferably about 130° to about 500° F. For example, the BPA stream may be in the range of about 350°-475° F.; the TPA may be in the range of about 250°-330° F.; and the QW may be at about 100°-230° F., preferably about 130°-230° F.

The manner of preheating the combustion air and thus enhancing the thermal efficiency in a hydrocarbon thermal cracking process and decreasing thermal pollution may be more fully understood from the following description when read in conjunction with FIG. 1, wherein the combustion air is shown to be preheated by employing the BPA, TPA and/or QW streams.

As shown therein, a hydrocarbon feed such as a naphtha or a gas oil which is to be thermally cracked in the presence of steam for the production of light gaseous olefins such as ethylene, propylene, butene, etc. and higher boiling products, is pumped at ambient temperature from storage tank 1 by pump 2 via line 3 into steam cracking coils exemplified by 4 located in furnace 5 which has a convection section 6 and a radiant heating section 7. Dilution steam is introduced into the steam cracking coil 4 in the convection section through line 8. In order to supply the sensible heat, heat of vaporization and cracking heat for the endothermal cracking reaction, fuel gas is supplied by line 9 to the burners (not shown) of the furnace, is mixed with preheated air flowing through the passage 10 from the combustion air intake unit 11 equipped with a forced draft fan 12, and burned. The combusted gases supply heat to the radiant section 7 of the furnace 5 and the flue gas passes upwardly to the stack 13 in indirect heat exchange with the incoming hydrocarbon feed which is at ambient temperature so that the flue gas temperature drops from about 1900°-2250° F. to about 225°-335° F. while the temperature of the feed is raised. The manner of preheating the air for combustion is explained in connection with the primary fractionator 14 in which the cracked products are both quenched with water and separated into fractions. Boiler feed water is passed by line 15 through separating drum 16 and line 17 into heat exchange in transfer line exchanger 18 with the hot pyrolysis effluent thus generating 600-2400 psig steam which is removed via line 19, drum 16 and line 20. The hot cracked products are then passed through transfer line 21 and are quenched with a quench oil which may be a portion of the BPA stream introduced through line 22 before being passed into a lower section of primary fractionator 14 in which they undergo distillation and are removed as separate fractions according to the boiling points.

Now in accordance with this invention, preheat for the combustion air may be provided by any one or several of the BPA, TPA or QW streams which may be taken from the primary fractionator 14. (If a separate water quench tower is provided preceding the primary fractionator, it is within the scope of the invention to take a QW stream from that.) These streams, after giving up a portion of their heat to the combustion air, may be returned to the primary fractionator and a part of the cooled stream may be removed as product or as purge in the case of QW. Thus a BPA stream may be pumped by means of bottom pumparound pump 23 via line 24 into heat exchange via one of the heat exchangers 25 with cool combustion air flowing through passage 10 to which the process stream will give up a portion of its heat. The BPA stream is then recycled to the primary fractionator 14. A portion of the BPA is taken off as fuel oil product through line 26. Similarly, a TPA stream may be pumped by means of top pumparound pump 27 via line 28 into heat exchange with cool combustion air and then recycled to the primary fractionator 14, a light cracked gas oil distillate product being taken off through line 29. A QW stream may be passed by means of quench water pump 30 via line 31 into heat exchange with cool combustion air; it is cooled by heat exchanger 32 and then returned to the primary fractionator, a quench water purge stream being removed through line 33. Additionally, an overhead distillate may be taken off through line 34 and an overhead vapor stream of light cracked products through line 35 and passed to a compressor (not shown). Other fractions may be obtained as desired.

Symbols used herein are defined as follows:

k=thousand

M=million klb/hr=thousands of pounds per hour

MBTU/hr=millions of British thermal units per hour

LHV=Lower Heating Value or net heat of combustion at 60° F.

HHV=Higher Heating Value or gross heat of combustion at 60° F.

Steam/HC=steam to hydrocarbon weight ratio

The invention is illustrated by the following examples which, however, are not to be construed as limiting.

EXAMPLE 1

Three naphtha and four gas oil furnaces are used to steam crack 446.5 klb/hr (63.9 wt %) of gas oil and 263.4 klb/hr (36.1 wt %) of naphtha. Steam dilutions are 0.35 and 0.50 lb/lb feed for gas oil and naphtha respectively. Ethane is recycled (with 0.30 steam/HC) to extinction. Each cracking furnace uses fuel gas and combustion air preheated to 350° F. or higher with the preheat duty supplied by quench water and the bottom pumparound stream from the primary fractionator. QW preheats the combustion air to 135° F. and BPA further preheats the air to 350° F. or higher. The stack temperature of the cracking furnace is 295° F. and stack excess air is 10% (over stoichiometric for completely burning the fuel gas). The primary fractionator is a single column provided with distillation plates which is used to separate the cracking furnaces' effluent into overhead vapor and liquid distillates, cracked gas oil and cracked tar. The overhead distillate is condensed in a direct contact condenser or quench water section in the top of the column.

The primary fractionator is capable of providing heat at three different temperature levels, viz, a BPA stream at 462/381° F., a TPA stream at 321/250° F., and a QW stream at 180/162° F.

A summary of the furnace firing conditions is shown in Table 1. The heat absorbed divided by the heat fired is 95.63 and 98.37% for the naphtha and gas oil furnaces, respectively. When the combustion air preheat is taken as fuel input, the overall furnace efficiency is 90.08 and 92.58% for the naphtha and gas oil furnaces, respectively. However, it should be noted that the primary fractionator heat is derived from the pyrolysis products, thus from the steam cracking furnaces, and therefore has already been counted as fuel input to the furnace. Hence, the ratio of heat absorbed to LHV fired is 95.63 and 98.37% respectively.

TABLE 1

| Furnaces | Naphtha | Gas Oil | Total |
|---|---|---|---|
| MBTU/hr: | | | |
| Total heat absorbed | 663.5 | 877.5 | 1,541.0 |
| Radiation and convective losses | 13.6 | 17.5 | 31.1 |
| Heat fired (LHV) | 693.8 | 892.0 | 1,585.8 |
| Combustion air preheat | 42.8 | 55.8 | 98.6 |
| Total release | 736.6 | 947.8 | 1,684.4 |
| Ht. Abs./Fired (LHV), % | 95.63 | 98.37 | 97.17 |
| Furnace Efficiency (LHV), % | 90.08 | 92.58 | 91.49 |

EXAMPLE 2

Studies were made in which steam cracking furnaces using air preheat and not using air preheat were compared. The results are shown in Table 2.

TABLE 2

STEAM CRACKING FURNACE AIR PREHEAT STUDIES PROCESS COMPARISON AND UTILITY REQUIREMENTS - 1 FURNACE

| | Case A | Case B | Case C |
|---|---|---|---|
| Source of Air Preheat | No Preheat | No Preheat | Primary Fractionator Top Pumparound |
| Quantity of Air Preheat, MBTU/hr | 0 | 0 | 12.9 |
| Stack Temperature, °F. | 461 | 335 | 331 |
| Gas oil Temperature to Furnace °F. | 220 | 254 | 98 |
| Feed Rate, k lb/hr | 150 | 150 | 150 |
| Air Temperature to Furnace, °F.(1) | 60 | 60 | 270 |
| Flue Gas Rate, klb/hr | 279 | 281 | 264 |
| $E_o$ = Ht Abs/Fired (LHV), % | 87.9 | 90.7 | 95.9 |
| Flow Rates, to/From) Furnace(2) | | | |
| Fuel Gas, lb/hr(3) | 13,690 | 13,780 | 12,990 |
| 600 psig Steam, klb/hr | — | (11.3) | — |
| Electric Power, | | | |
| Installed KW | — | 140.6 | 34.1 |
| Operating KW | — | 64.3 | 25.5 |

(1)Excess air = 15%
(2)Except for fuel gas all quantities shown are deltas from Case A.
(3)Fuel gas has heating value of 21,200 BTU/lb (LHV); 23,500 BTU/lb (HHV).

Case C is operated in accordance with the invention; Cases A and B are shown for purposes of comparison.

Case A represents a cracking furnace in which flue gas at a temperature of 461° F. is given off into the atmosphere, releasing more than desirable waste thermal energy to the environment.

Case B represents a cracking furnace in which the stack temperature is lowered from 461° F. to 335° F. by generating 600 psig steam in the convection section of the furnace through heat exchange with the flue gas. In Case C, oil feed enters the furnace convection section essentially at ambient temperature. Heat exchange of the cold feed with flue gas reduces the stack temperature to 331° F. It may be noted that although the stack temperatures are approximately the same, in Case C about 5% less fuel is required which leads to a similar decrease in flue gas, i.e., the mass velocity in the stack is lower so that the heat loss from that source is less. It may also be mentioned that Case B requires a considerably more complicated apparatus to achieve preheating of the furnace oil feed to 254° F. Also more capital investment is required for facilities to preheat the feed to 254° F. in exchange with the BPA and/or TPA from the primary fractionator.

Case C uses TPA from the primary fractionator to provide 12.9 MBTU/hr of air preheat duty for the furnace. This same TPA heat duty is used to preheat the furnace oil feed in Case B.

Thus, although Case B and Case C are both utilizing the same amount of TPA heat duty, but in different ways, $E_o$ is greater for Case C in which it is used to preheat the combustion air, viz, 95.9% versus 90.7%, these percentages already allowing credit to Case B for the steam it generates.

Figure 2:
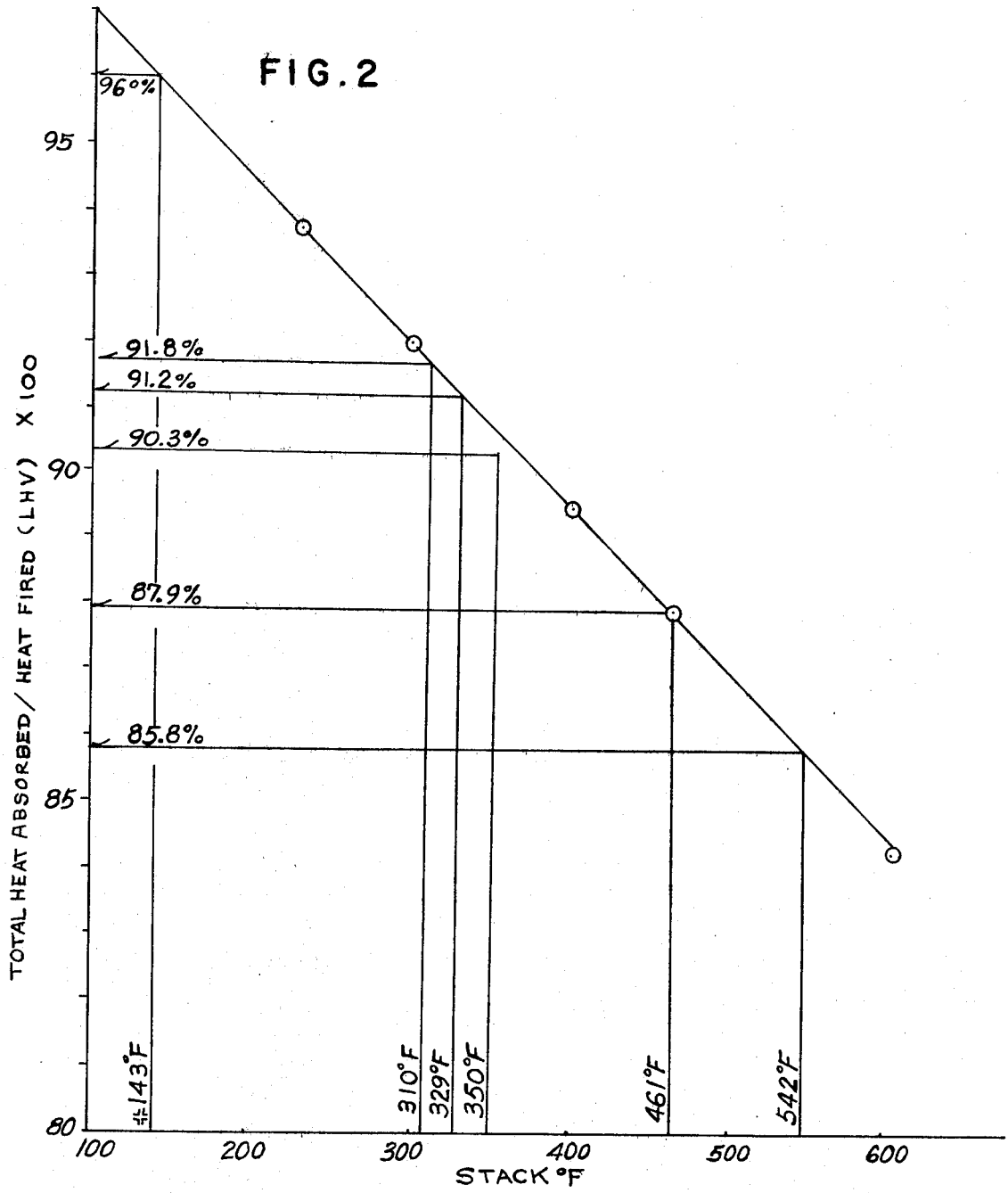
FIG. 2 is a graph showing stack temperature plotted against $$\frac{\text{total heat absorbed}}{\text{heat fired}} \times 100$$

In FIG. 2, points were plotted for stack temperatures between about 330° F. and 461° F. against $$\frac{\text{Total Heat Absorbed} \times 100}{\text{Heat Fired (LHV)}}$$

for systems using 15.0% excess air, not using air preheat and a curve, which was extrapolated, was obtained. Since Case C attains 95.9 as this percentage, this is equivalent to a stack temperature of about 143° F. or in other words from a thermal efficiency point of view preheating combustion air to 270° F. with low level temperature waste heat streams is equivalent to cutting the stack temperature by about 185° F.

The present invention achieves a unique, beneficial cooperation between a steam cracking furnace and an externally located downstream primary fractionator whereby low level waste heat is supplied by streams cycled from the latter to the former to preheat combustion air, with the result that fuel is conserved and the ratio of heat absorbed to heat fired is increased even over other alternatives for utilizing heat from the same streams. In order to practice the invention it is not necessary to employ a pyrolysis reactor of special construction but rather units of conventional design that can be used nor does it impose any restraint with regard to quenching the pyrolysis products.

What is claimed is:

1. In a process in which a hydrocarbon feed is cracked in the presence of steam at temperatures in the range of about 1200° to 1800° F. in a pyrolysis reactor located within a furnace burning a mixture of fuel and air and the pyrolysis products are passed to an externally located, connected primary fractionator where they are separated into fractions by distillation, the improvement which comprises preheating the combustion air by heat exchange with liquid low level temperature streams taken from the primary fractionator which may be TPA, BPA and/or QW, the cooled streams being returned at least in part to the primary fractionator.

2. The process as set forth in claim 1 in which the hydrocarbon feed is an oil and/or a gas at normal temperature and pressure.

3. The process as set forth in claim 1 in which the combustion air is preheated to a temperature within the range of about 150° to 450° F.

4. The process as set forth in claim 1 in which the pyrolysis products are quenched with oil before they are passed to the primary fractionator.

5. The process as set forth in claim 1 in which the stack temperature is in the range of about 295° to 335° F. and is reduced to such temperature by heat exchange of the flue gas with cooler hydrocarbon feed being introduced into the pyrolysis reactor.

6. A process as set forth in claim 1 in which the BPA and QW are used for preheating the combustion air.

7. The process as set forth in claim 1 in which the liquid streams taken from the primary fractionator are at low temperature levels in the range of about 130° to 500° F.

8. The process as set forth in claim 7 in which BPA is available at a temperature in the range of about 350° to 475° F., TPA in the range of about 250° to 330° F. and QW in the range of about 130° to 230° F.

9. The process as set forth in claim 7 or 8 in which the TPA, after it has given up some of its heat to the combustion air, is recycled to the primary fractionator with a portion being removed as light cracked gas oil distillate product.

10. The process as set forth in claim 7 or 8 in which the QW, after it has given up some of its heat the combustion air, is recycled to the top of the primary fractionator with a portion being removed as quench water purge.

11. The process as set forth in claim 8 in which the TPA has a boiling range of about 350° to 750° F. and the BPA has an initial boiling point of about 550° F.

12. A process as set forth in claim 1 in which the fuel is a gas.

13. In a process in which a hydrocarbon feed is cracked in the presence of steam at temperatures in the range of about 1200° to 1800° F. in a pyrolysis reactor located within a furnace which supplies heat to the reactor by burning a mixture of fuel gas and air and the pyrolysis products are quenched with a quench oil and passed to an externally located, connected primary fractionator where they are separated into fractions by distillation, the improvement which comprises preheating the combustion air by heat exchange with low level temperature streams taken from the primary fractionator which may be TPA, BPA and/or QW, the flue gas temperature being reduced to about 295° to 335° F. by heat exchange with hydrocarbon feed at ambient temperature before the feed is introduced into the pyrolysis reactor.

* * * * *